United States Patent [19]

Boaz

[11] Patent Number: 4,610,316

[45] Date of Patent: Sep. 9, 1986

[54] FREE FLOW STABILIZER

[75] Inventor: James Boaz, Tucson, Ariz.

[73] Assignee: LOR, Inc., Houston, Tex.

[21] Appl. No.: 674,259

[22] Filed: Nov. 23, 1984

[51] Int. Cl.[4] ..... E21B 17/10

[52] U.S. Cl. ..... 175/323; 175/325

[58] Field of Search ..... 175/323, 325; 308/4 A

[56] References Cited

U.S. PATENT DOCUMENTS

| | | | |
|---|---|---|---|
| 4,231,437 | 11/1980 | Swersky et al. | 175/325 |
| 4,396,234 | 8/1983 | Garrett | 175/325 |
| 4,436,158 | 3/1984 | Carstensen | 175/325 |

OTHER PUBLICATIONS p. 18 of LOR 1984–1985 Composite Catalog.

*Primary Examiner*—Stephen J. Novosad
*Assistant Examiner*—William P. Neuder
*Attorney, Agent, or Firm*—Pravel, Gambrell, Hewitt & Kimball

[57] ABSTRACT

A bladed stabilizer including an upper body section having an upper annular flow area between the outside surface of the upper body section and the walls of the bore hole. The stabilizer further includes a lower body section wherein a plurality of blades are mounted for the purposes of reaming the hole. The outside diameter of the lower body section and the cross-sectional measurements of the welded blades combine to provide a net annular blade flow area between the lower body section and blades and bore hole which is greater than the flow area available past the upper body section so that flow past the stabilizer is maximized.

18 Claims, 3 Drawing Figures

| A | B | C | D | E | F | G | H | I | J | K |
|---|---|---|---|---|---|---|---|---|---|---|
| SIZE (INCHES) | FINISH BLADE DIAMETER | AREA FINISH BLADE AND BOREHOLE DIAMETER | UPPER BODY DIAMETER | AREA UPPER BODY DIAMETER | LOWER BODY DIAMETER | AREA LOWER BODY | NUMBER AND SIZE BLADES | TOTAL AREA OF ALL BLADES | FLOW AREA - BLADE AREA J=C-G-I | FLOW AREA UPPER BODY K=C-E |
| 1 | 6.125 | 29.465 | 5.000 | 19.635 | 4.000 | 12.566 | 3 2.000x1.060 W x T | 6.360 | 10.539 | 9.830 |
| 2 | 11.750 | 108.434 | 10.750 | 90.763 | 9.750 | 74.662 | 3 4.000x1.000 | 12.000 | 21.772 | 17.671 |
| 3 | 9.375 | 69.029 | 8.750 | 60.132 | 7.375 | 42.718 | 3 4.000x1.000 | 12.000 | 14.311 | 8.897 |
| 4 | 11.750 | 108.434 | 10.750 | 90.763 | 9.750 | 74.662 | 3 4.000x1.000 | 12.000 | 21.772 | 17.671 |
| 5 | 10.250 | 82.516 | 9.250 | 67.201 | 8.500 | 56.745 | 3 3x .875 | 7.875 | 17.896 | 15.315 |

FIG. 3

FREE FLOW STABILIZER

TECHNICAL FIELD OF THE INVENTION

The present invention relates to the field of drilling of bore holes for setting mining blasts and for drilling bore holes for other purposes.

BACKGROUND OF THE INVENTION

Typically, welded blade stabilizers are used in oil well drilling and blast hole drilling. In typical oil well drilling, drilling fluid is circulated downwardly through the drill string outwardly at the drill bit in order to circulate upwardly to the surface return drilling fluid containing drill cuttings so that the drill cuttings are continuously removed from the bottom of the hole. In blast hole drilling, the concept is essentially the same except that it is usually air that is circulated through the drill string and outwardly at the bit so that the return air circulating in the annular area between the drill string and the bore hole contains the cuttings which need to be circulated outwardly from the bottom of the hole. Welded blade stabilizers are used in both oil well drilling and blast hole drilling. A welded blade stabilizer generally includes a cylindrical body having multiple helically angled blades welded to the body. The stabilizer is mounted onto the drill string above the bit so that the welded-on blades may engage the side walls of the bore as freshly cut by the drill bit to further ream out the bore hole and stabilize the drill string and bit in position.

In such drilling operations such as blast hole drilling where air is used to circulate cuttings off of the bottom of the bore hole, a problem with prior art welded stabilizers is inhibited upward circulation of the return air and cuttings. Due to turbulence and restriction in the annular flow space caused by the stabilizer itself, it is known that air flow is inhibited and that drilling chips or cuttings may become stuck in the vicinity of the blades, thus preventing clear return circulation of the air and drill cuttings. The clogging of the drill cuttings in the area of the stabilizer blades causes the drill chips to fall back into the bit area and be reground. This regrinding slows down the drilling rate and decreases the life of the drill bit.

SUMMARY OF THE INVENTION

This invention is directed to a free flow stabilizer for mounting in a drill string above the drill bit to provide for substantially free flow of the return drilling fluid such as air along with the drill cuttings. It is an object of this invention to provide substantially the same net flow area in the area of the blades as in the area of the remainder of the body of the stabilizer so that the flow past the stabilizer of return fluid and cuttings is substantially continuous, uninhibited and maximized. This consistent area provides a uniform velocity of fluid and cuttings throughout the length of the stabilizer, which prevents localized undercutting and erosion of the stabilizer. The bladed stabilizer of the preferred embodiment of this invention includes an upper body section having a generally cylindrical cross-sectional configuration and having an outside diameter which is diametrically spaced inwardly from the bore hole to form an upper annular flow area. The bladed stabilizer further includes a lower body section formed with said upper body section and having a generally cylindrical cross-section. The lower body section has an outer diameter which is less than the outer diameter of the upper body section. The upper and lower body sections cooperate to provide a continuous internal body bore for the circulation of a drilling fluid such as air downwardly through the stabilizer.

A plurality of spirally directed blades are mounted on the lower body section in an equally, circumferentially spaced relationship with respect to each other. The spirally designed blades have a greater wall contact area and therefore provide better stabilization than straight blades of the same number and size. The outer diameter of the mounted blades form the reaming diameter of the stabilizer for providing a bore hole of such reaming or reamed diameter. The spirally directed blades and the lower body section cooperate to provide a net annular cross-sectional flow area with respect to the bore hole. The net annular blade flow area is greater than the upper annular flow area formed between the bore hole and the upper body section whereby the flow rate of return drilling fluid and cuttings circulating past the blades is substantially uninhibited by the presence of the blades and thus substantially maximized.

BRIEF DESCRIPTION OF THE DRAWINGS

FIG. 3 is a table illustrating critical dimensions for various sized free flow stabilizers.

DESCRIPTION OF THE PREFERRED EMBODIMENT

Figure 1:
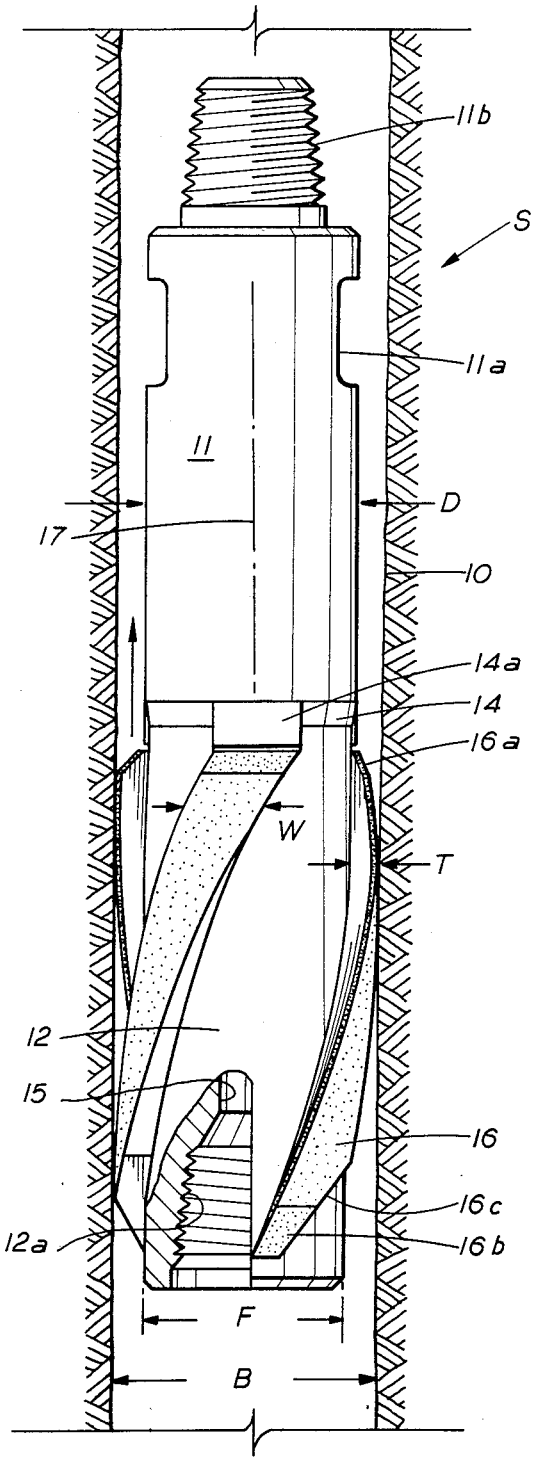
FIG. 1 is a side view partly in section of the free flow stabilizer of the preferred embodiment of this invention illustrated in position is a bore hole.

Referring to the drawings, the letter S generally designates the free flow stabilizer of the preferred embodiment of this invention. The free flow stabilizer is illustrated as being mounted in a bore hole 10, which may be the bore hole of an oil well or a blast hole or other bore hole. The free flow stabilizer S includes an upper body section 11 and a lower body section 12. The upper body section 11 is generally cylindrical in cross-sectional configuration and is formed with a cylindrical outside surface having an outside diameter D. The upper end of the upper body section 11 includes a series of chord-like diametrical wrench flat areas 11*a* which are machined into the upper body section to receive various tools. The upper body section terminates in an upper pin or male threaded end portion 11*b* having a thread configuration which is adapted to thread into a corresponding female or box member of a drill string joint.

The lower body section 12 is also generally cylindrical in configuration and includes an outer, generally cylindrical surface having an outside diameter designated as F. An intermediate body section 14 is formed between the upper body section 11 and the lower body section 12. The lower body section 12 terminates in an internal female or box threaded end portion 12*a* which is adapted to be mounted by threaded connection into a pin end portion of a drill bit.

The upper body section 11, intermediate body section 14 and lower body section 12 cooperate to provide a continuous, uninterrupted internal bore 15 which is cylindrical in cross-section and is provided for the purpose of allowing drilling fluid such as air to be circulated downwardly through the tool toward the drill bit which is mounted below the box end 12*a* of the stabilizer S.

The intermediate body section 14 has an outside surface of gradually reducing diameter from top to bottom thus providing a cylindrically tapered or frustro-conical surface to provide a transition surface from the outer surface of the upper body section 11 to the outer surface of the lower body section 12.

A plurality of stabilizer blades 16 are welded onto the outer surface of the lower body section 12. In the embodiment illustrated in FIG. 1, the number of blades is three. Each blade is generally rectangular or trapezoidal in cross-section and thus may be defined as having a width W and a radial thickness T as viewed in a cross-section perpendicular to the central axis 17 of the tool. Each blade is spiraled in order to wrap around the outside surface of the lower body section 12 of an angular distance of approximately 120° so that the combination of the three blades substantially cover the entire 360° circumference of the lower body section 12. Each blade 16 is radially tapered at its upper end 16*a* and is also radially tapered at its lower end 16*b*. Additionally, each blade is tapered in width at its lower end along a taper line 16*c*. Each blade is mounted onto the outside surface of the lower body section 12 such that a continuous spiral or helix angle of approximately 10° is formed between the blade and the central axis 17 of the tool. This helix angle changes with diameter and stabilizer blade length required.

Figure 2:
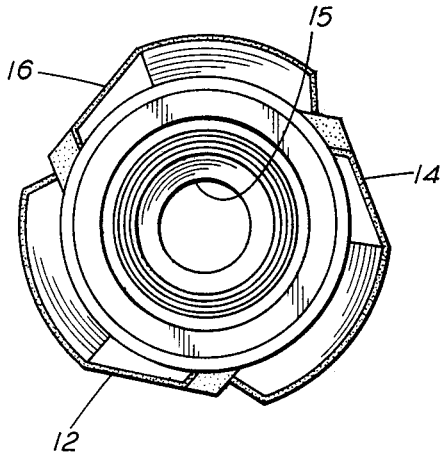
FIG. 2 is a bottom view of the stabilizer illustrating the circumferential positioning of the welded blades.

Each of the blades 16 is provided with a hardened tungsten carbide bonded material H (FIG. 2) on the entire outside surface of the blade. The providing of a hard facing utilizing tungsten carbide in a matrix is well-known in the art. One such process is Applicant's own T-2000 hardfacing process which provides the tungsten particles in a special hard matrix material which is actually metallurgically bonded to the surface of the blades. However, it should be understood that other types of hardfacing also known in the art may be utilized on the surface of the welded blades.

Additionally, hardfacing portions 14*a* are deposited upon the intermediate body section 14 in alignment with each welded blade. The curvature of the outside surface of each of the hardfacing portions 14*a* is the same as the curvature of the outside surface of the upper body section 11 so that the hardfacing areas 14*a* deposited onto the intermediate body section 14 provide for a continuity of surface between the upper body section 11 and the upper tapered end portions 16*a* of each of the welded blades.

The upper annular flow area is defined in the chart of FIG. 3 by the letter K. The upper annular flow area K is the difference between the area formed by the bore hole itself, which is defined as the finished blade area C in FIG. 3, and the area of the upper body section of the diameter D. This annular area between the upper body section 11 and the surface or wall of the bore hole 10 itself defines the flow area which is available in the stabilizer tool. That flow area is basically the same flow area as is available throughout the rest of the drill string because the outer diameter D of the upper body section 11 is substantially the same size as the outer diameter of the remaining joints of the drill string. Therefore, the annular flow area between the bore hole 10 and the upper body section 11 is the effective flow area which is available throughout the drill string.

The stabilizer S of the preferred embodiment of this invention provides for a combination of critical diameters for the lower body section 12 and sizes for the blades 16 such that the net annular blade flow area J past the lower body section 12 is at least equal to the flow area past the upper body section 11. In this manner, return fluid such as air carrying cuttings upwardly past the tool away from the bottom of the bore hole do not have to pass a region of diminished flow area, which is a problem with known stabilizers. Typically, a stabilizer such as the free flow stabilizer S of the preferred embodiment of this invention, in a blast hole application, is mounted just above the drill bit. Forced air is circulated downwardly through the drill string and through the stabilizer S and outwardly of the bottom of the drill string in the vicinity of the drill bit so that the forced air flow reverses course and returns upwardly past the stabilizer S and away from the bottom of the bore hole. The return air carries with it drill cuttings so that the bottom of the bore hole remains free of drill cuttings and the drill bit can continue to rotate and cut the bore hole effectively. The stabilizer S of this invention has a net annular blade flow area J which is greater than the flow area K available in the upper body section of the stabilizer and in the remainder of the drill string so that the blade area does not cause a clogging or turbulence area which clogs up and catches cuttings and keeps them from circulating out of the path of the drill bit. If these cuttings are not properly circulated away from the drill bit, the cuttings tend to fall back into the path of the drill bit and be reground. Such regrinding decreases the drilling efficiency of the drill bit and reduces the life of the bit. Additionally, the catching of these drill cuttings upon the blades also tends to cause additional wear on the blades of the stabilizers themselves.

Referring to FIG. 3, a series of five sizes are illustrated wherein the lower body diameter is approximately 1 inch less than the upper body diameter and the size of each of the three blades in cross-section is such that the net annular blade flow area J is greater than the flow area K past the upper body section. The diameter C of the bore hole is equal to the finished blade diameter B because the outside surface of the stabilizer blades actually ream out the bore hole to that size. It should be remembered that the blade outside diameter of a new stabilizer is designed approximately $\frac{1}{4}''$ to $\frac{3}{8}''$ smaller than the gage diameter of a new drill bit. This is done to prevent damage to a new stabilizer when run with an out of gage (used) bit. Thus the annular area is the area between the upper body section 11 of the tool and the walls of the bore hole itself. Similarly, the net annular blade area is the available flow area between the wall of the bore hole, which is defined by the diameter C and the lower body section and blades. As shown in FIG. 3, the net annular flow area J past the lower body section where the blades are mounted is in each of the five models greater than the flow area available between the upper body section and the wall of the bore hole. In this manner, flow through the stabilizer is maximized and clogging and regrinding and turbulence in the area of the blades is eliminated.

The foregoing disclosure and description of the invention are illustrative and explanatory thereof, and various changes in the size, shape and materials, as well as in the details of the illustrated construction may be made without departing from the spirit of the invention.

I claim:

1. A bladed stabilizer for mounting in a drill string of a generally cylindrical configuration and a generally uniform outer diameter above a drill bit to ream and stabilize a bore hole, comprising:

an upper body section having a generally cylindrical configuration, having an outer diameter which is diametrically spaced inwardly from the bore hole to form an upper annular flow area, and is substantially the same size as the outer diameter of the drill string;

a lower body section formed with said upper body section and having generally cylindrical configuration, said lower body section having an outer diameter which is less than the outer diameter of said upper body section;

said upper and lower body sections cooperating to provide a continuous internal body bore for the circulation of a drilling fluid such as air downwardly through said stabilizer;

a plurality of spirally directed blades mounted on said lower body section in an equally circumferentially spaced relationship with respect to each other, the outer diameter of said mounted blades forming the reaming diameter of said stabilizer for reaming the bore hole to said reaming diameter;

said blades and said lower body section cooperating to provide a net annular blade flow area with respect to said bore hole, which net annular blade flow area is greater than said upper annular flow area past said upper body section whereby the flow rate of drilling fluid and cuttings circulating past said blades is at least equal to the flow rate of such cuttings passing said upper body.

2. The structure set forth in claim 1, including:

an intermediate body portion formed between said upper and lower body section, said intermediate body section having a gradually reducing diameter to provide a cylindrical outside tapered surface from said upper body section to said lower body section.

3. The structure set forth in claim 2, including:

a plurality of intermediate sections of hardened material deposited onto said intermediate body outside surface in alignment with each of said spirally directed blades.

4. The structure set forth in claim 3, wherein:

each of said deposits of hardened material has an outside curvature equal to the curvature of the outside cylindrical surface of said upper body section.

5. The structure set forth in claim 1, wherein said net annular blade flow area is:

the cross-sectional area of said bore hole minus the sum of the cross-sectional area of said blades plus the cross-sectional area of said outer diameter of said lower body section.

6. The structure set forth in claim 5, wherein:

each of said blades is rectangular in cross-section as mounted on said lower body section; and said cross-sectional area of each blade is equal to its width times its radial thickness.

7. The structure set forth in claim 6, including:

each blade is spirally directed and terminates at a lower end having a section which is tapered in width, said width tapered section also being tapered radially inwardly.

8. The structure set forth in claim 1, wherein said upper annular flow area is:

the cross-sectional area of said bore hole minus the cross-sectional area of said outer diameter of said upper body section.

9. The structure set forth in claim 1, wherein:

the outside diameter of said upper body section is 5.0 inches;

the outside diameter of said lower body section is 4.0 inches;

the number of blades mounted on said lower body section is 3; and the width of each blade is 2.0 inches and the radial thickness of each blade is 1.06 inches.

10. The structure set forth in claim 9, wherein:

said upper annular flow area is 9.830 square inches; and said net annular blade flow area is 10.539 square inches.

11. The structure set forth in claim 1, wherein:

the outside diameter of said upper body section is 10.750 inches, the outside diameter of said lower body section is 9.750 inches;

the number of blades mounted on said lower body section is 3; and the width of each blade is 4.0 inches and the radial thickness of each blade is 1.0 inches.

12. The structure set forth in claim 11, wherein:

said upper annular flow area is 17.67 inches; and said net annular blade flow area is 21.77 inches.

13. The structure set forth in claim 1, wherein:

the outside diameter of said upper body section is 8.75 inches;

the outside diameter of said lower body section is 7.37 inches;

the number of blades mounted on said lower body section is 3; and the width of each blade is 4.0 inches and the radial thickness of each blade is 1.0 inches.

14. The structure set forth in claim 13, wherein:

said net upper annular flow area is 8.89 square inches; and said net annular blade flow area is 14.31 inches.

15. The structure set forth in claim 1, wherein:

the outside diameter of said upper body section is 10.75 inches;

the outside diameter of said lower body section is 9.75 inches;

the number of blades mounted on said lower body section is 3; and the width of each blade is 4.0 inches and the radial thickness of each blade is 1.0 inch.

16. The structure set forth in claim 15, wherein:

said upper annular flow area is 17.67 square inches; and said net annular blade flow area is 21.77 inches.

17. The structure set forth in claim 1, wherein:

the outside diameter of said upper body section is 9.25 inches;

the outside diameter of said lower body section is 8.50 inches;

the number of blades mounted on said lower body section is 3; and the width of each blade is 3.0 inches and the radial thickness of each blade is 0.875 inches.

18. The structure set forth in claim 17, wherein:

said upper annular flow area is 15.31 square inches; and said net annular blade flow area is 17.89 square inches.

* * * * *